US010731944B1

(12) United States Patent
Struss

(10) Patent No.: US 10,731,944 B1
(45) Date of Patent: Aug. 4, 2020

(54) ILLUMINATED NUNCHUCKS

(71) Applicant: Jay Struss, Woodland Park, CO (US)

(72) Inventor: Jay Struss, Woodland Park, CO (US)

( * ) Notice: Subject to any disclaimer, the term of this patent is extended or adjusted under 35 U.S.C. 154(b) by 0 days.

(21) Appl. No.: 16/533,999

(22) Filed: Aug. 7, 2019

(51) Int. Cl.
*F41B 15/00* (2006.01)
*F21V 33/00* (2006.01)

(52) U.S. Cl.
CPC ..... *F41B 15/00* (2013.01); *F21V 33/00* (2013.01)

(58) Field of Classification Search
CPC ..... F21V 33/00; F41B 15/00
See application file for complete search history.

(56) References Cited

U.S. PATENT DOCUMENTS 3,454,274 A 7/1969 Kaneshiro
3,608,899 A * 9/1971 Hall ..... F41B 15/00 463/47.5
3,937,468 A * 2/1976 Conde, Sr. ..... A63B 69/004 463/47.5
4,017,073 A * 4/1977 Dolan ..... F41B 15/00 463/47.5
4,023,803 A * 5/1977 Lewis ..... F41B 15/00 463/47.5
4,070,023 A * 1/1978 Cutler ..... F41B 15/00 463/47.5
4,462,593 A * 7/1984 Carty, Jr. ..... A63B 69/004 463/47.5
5,087,034 A 2/1992 Solis
5,524,886 A * 6/1996 Kim ..... F41B 15/00 463/47.5
5,547,190 A * 8/1996 Mackewich, Jr. ..... F41B 15/00 362/102
D382,608 S * 8/1997 Hayes ..... D21/798
6,024,467 A * 2/2000 Liu ..... G02B 27/20 362/118
6,126,292 A * 10/2000 Liu ..... F21V 33/0076 362/102
6,299,537 B1 * 10/2001 Clowser ..... A63B 69/004 362/102
6,398,652 B1 * 6/2002 Schweizer ..... A63B 69/004 463/47.5
7,625,289 B1 12/2009 Fagliarone
8,529,087 B2 9/2013 Bertken
2006/0019754 A1 * 1/2006 Chang ..... F41B 15/00 463/47.5

(Continued)

OTHER PUBLICATIONS

Metal Glowstick Twisters (Glowstick Nunchucks). Product Description [online]. Autodesk, Inc. [retrieved on Mar. 23, 2016]. Retrieved from the Internet: <URL:https://www.instructables.com/id/Metal-Glowstick-Twisters-Glowstick-Nunchucks/>.

(Continued)

*Primary Examiner* — Jong-Suk (James) Lee
*Assistant Examiner* — Christopher E Dunay
(74) *Attorney, Agent, or Firm* — Cramer Patent & Design, PLLC; Aaron R. Cramer

(57) ABSTRACT

A pair of hollow tubular members is connected at a first end by a tether. Each distal end of the tether is held in place within each respective end of the tubular member by a sealed ball bearing assembly. Within each tubular member is a cavity suitable to secure a light stick. Each second end of each tubular member has a friction fit cap. Illumination from the light stick emanates through the tubular hollow members or through cut portions thereof.

20 Claims, 6 Drawing Sheets

(56) References Cited

U.S. PATENT DOCUMENTS

2014/0211450 A1 7/2014 Nagel et al.

OTHER PUBLICATIONS

Hot-selling led colorful in the nunchaku glow stick performance props handheld neon stick. Product Listing [online]. AliExpress. [retrieved on Mar. 23, 2016]. Retrieved from the Internet: <URL:https://www.aliexpress.com/item/1762532679.html>.

* cited by examiner

ILLUMINATED NUNCHUCKS

RELATED APPLICATIONS

Not applicable.

FIELD OF THE INVENTION

The present invention relates generally to illuminated nunchucks.

BACKGROUND OF THE INVENTION

Nunchucks are a traditional Okinawan martial arts weapon consisting of two sticks connected at one end by a short chain or rope. They are most widely used in martial arts such as Okinawan kobudō and karate, and are used as a training weapon, since it allows the development of quicker hand movements and improves posture.

While nunchucks are relatively simple in design, there has a been a recent surge by various manufacturers to increase their aesthetic appeal by the inclusion of battery powered lights which produce an eye-catching display when used in nighttime or low light conditions. These lights are powered by batteries and associated electronics that are somewhat fragile in nature and are housed in plastic tubes or "sticks" which are incapable of standing up the actual physical use of conventional nunchucks. Also, most nunchucks use a simple mechanical swivel joint connection at their connected end, which while functional, does not provide for smooth or fast operation.

Accordingly, there exists a need for a means by which nunchucks can be provided with the ability to produce an eye-catching light display but still stand up the actual usage demands of conventional nunchucks which operate in a smooth manner. The development of the nunchucks with visual and performance enhancements 10 fulfills this need.

SUMMARY OF THE INVENTION

The inventor has recognized the aforementioned, inherent problems and lack in the art and observed that there is a need for a pair of nunchucks first comprising a pair of sticks which are connected together by a tether. Each of the pair of sticks includes a lower handle region and an upper handle region. A proximal end of the upper handle region of each of the pair of sticks has a sealed bearing assembly which is a joining mechanism between each of the sticks and the tether. Each of the lower handle region includes a distal end that is open and plugged with an end cap. Second, the pair of nunchucks comprises a lower band circumscribing an outer perimeter of each of the sticks and overlaps each of the end plugs. The lower band is attached or removed to keep each of the end plugs inserted into each of the open ends of the lower handle region of the sticks. Third, the pair of nunchucks comprises an intermediate band removably placed on each of the sticks. The intermediate band delineates each of the sticks into the lower handle region and the upper handle region. Fourth, the pair of nunchucks comprises an upper band aiding in restricting detritus or foreign objects from entering the sealed bearing assembly and hindering operation thereof.

Fifth, the pair of nunchucks comprises a set of through-cut graphical elements provided along a length of the lower handle region adjacent to the location of the lower band. The through-cut graphical elements are cut completely, such that it exposes an interior cavity. Sixth, the pair of nunchucks comprises a chemical light stick disposed within the interior cavity. Seventh, the pair of nunchucks comprises a retaining strap attached to the end plug which is inserted through an aperture provided in a center axial position of the end plug. Last, the pair of nunchucks comprises a stopper placed over an opposing end of the chemical light stick as a cap. The stopper has a domed receiver and a pair of fins that are diametrically opposed and extend outward from the domed receiver. The fins of the stopper engage the interior of the stick and prevent unintended removal of the chemical light stick from the end plug when the nunchucks are used. The tether may be located at the center of the assembly with the internal seal face being immediately adjacent thereto, wherein the internal seal face contains a plurality of ball bearings along their exterior.

Each of the pair of sticks may be identical. The end cap may removably accesses an interior cavity. The end cap may also be made of pliable material such as rubber. Each of the upper handle regions may be sized to enable a final user to grip each of the sticks. Each of the lower handle regions may be in the range of seven to seven-and-a-half inches in length while each of the upper handle regions may be in the range of four to four-and-a-half inches in length. The sticks may be made from metal tubing and may be durable and possess high strength properties. The metal tubing may be aluminum or titanium. The sealed bearing assembly may allow for a smooth quiet rotation of the tether in a three-hundred-sixty-degree arc. The tether may be a heavy-duty nylon cable. Each of the pair of sticks may be made of a transparent material.

Each of the pair of sticks is made of a translucent material. Each of the end plugs may be held in place using a set of friction fit holding rings which grip the interior cavity. The through-cut graphical elements may allow for emanation of illumination. The through-cut graphical elements may also comprise texts selected from the group consisting of fonts, numbers, graphical designs, logos, design elements, pictures, or caricatures. The chemical light stick may be self-contained, short-term light-source having a translucent plastic tube containing isolated substances that, when the isolating substances are combined, produce light through chemiluminescence.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
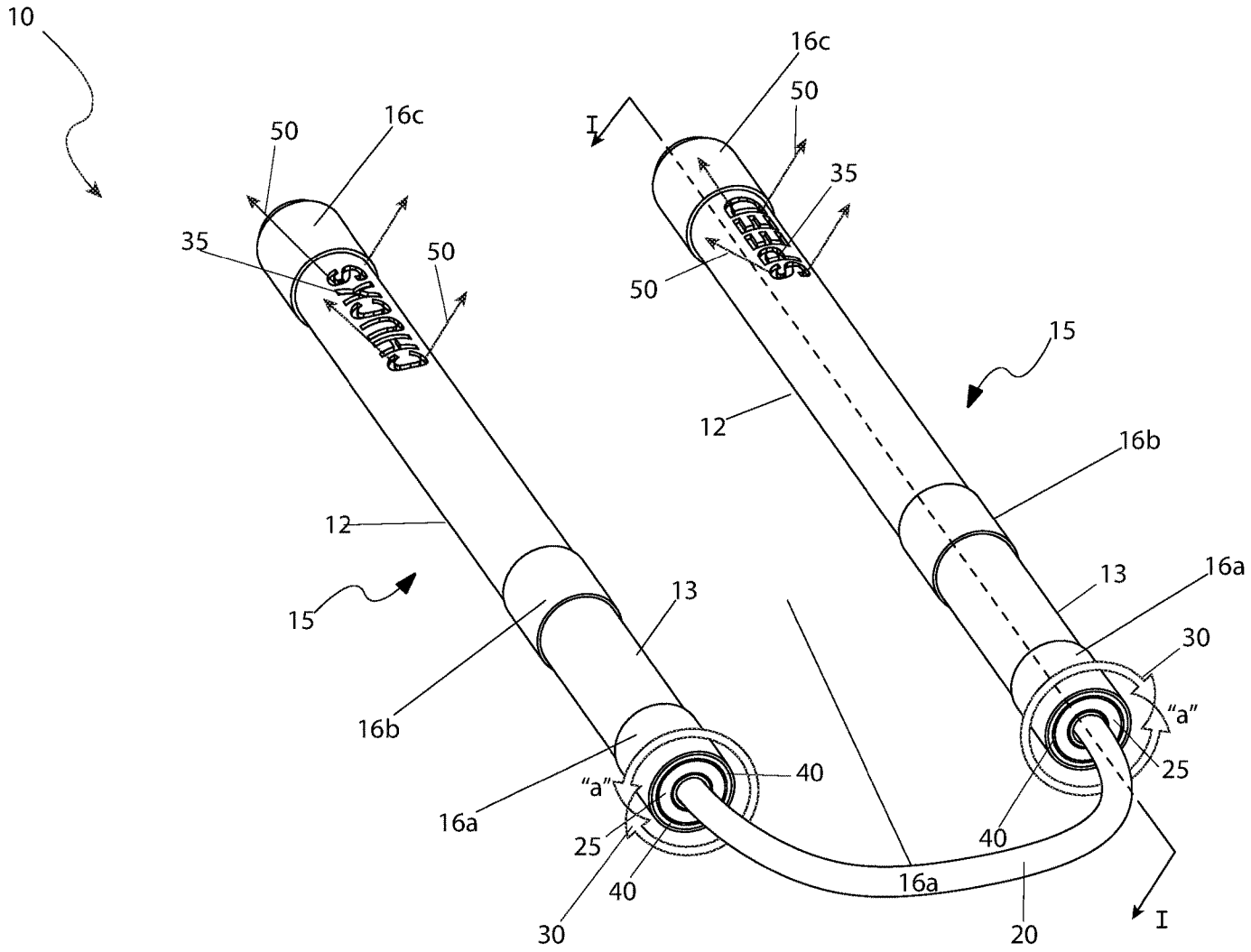
FIG. 1 is a perspective view of the nunchucks 10, according to the preferred embodiment of the present invention.

10 nunchucks
11 alternate nunchuck embodiment
12 lower handle region
13 upper handle region
15 stick
16*a* upper band
16*b* intermediate band
16*c* lower band
20 tether
25 sealed bearing assembly
30 rotational travel path 'a'
35 through-cut graphical element
36 decal
40 tubing wall
45 interior cavity
50 illumination
55 end plug
57 stopper
60 chemical light stick
65 retaining strap
70 aperture
75 friction fit holding ring
80 travel path "f"
85 center bearing face
90 retention device
95 external seal face
100 internal seal face
105 external race
110 ball bearing

DESCRIPTION OF THE PREFERRED EMBODIMENTS

Figure 3:
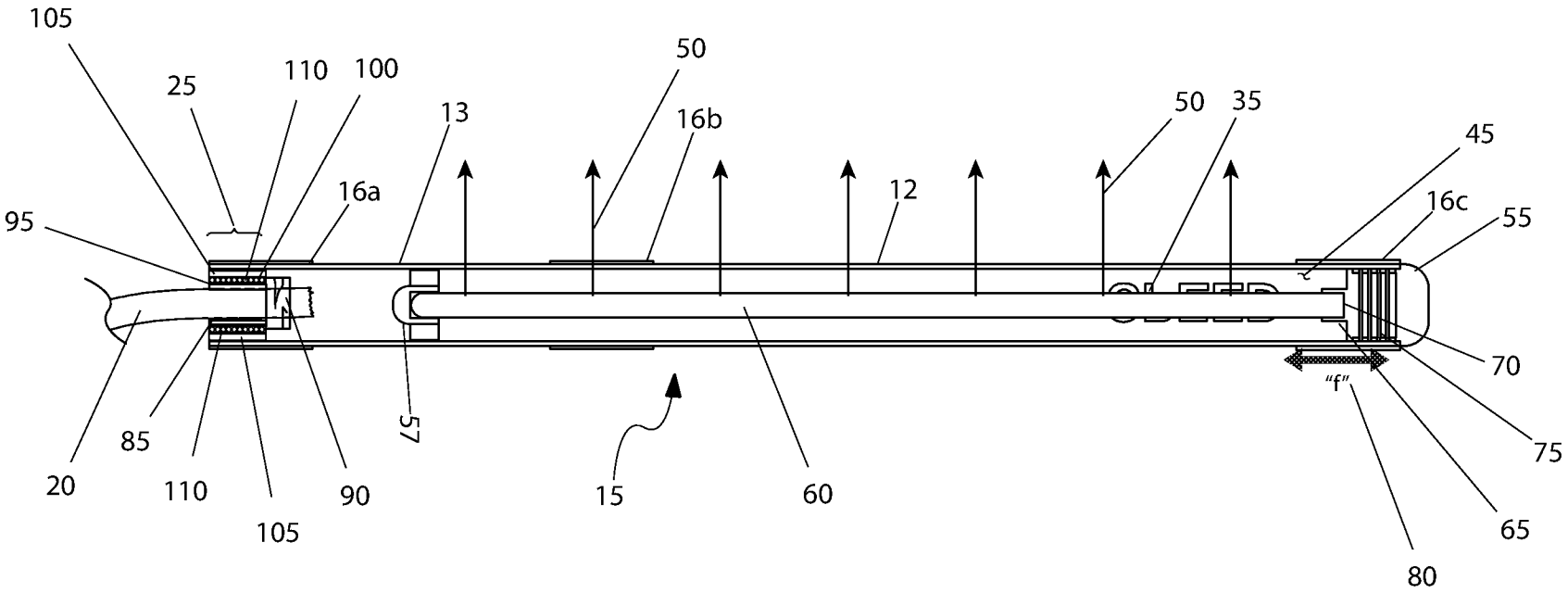
FIG. 3 is a sectional view of the nunchucks 10, as seen along a line I-I, as shown in FIG. 1, according to the preferred embodiment of the present invention.
Figure 4:
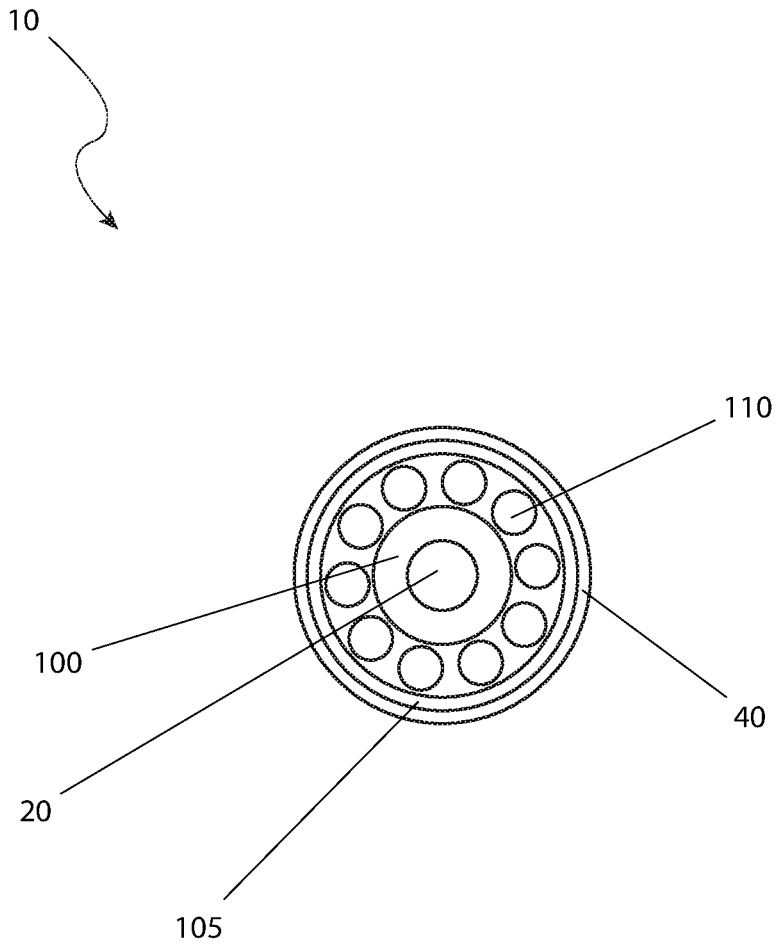
FIG. 4 is a sectional view of the nunchucks 10, as seen along a line II-II, as shown in FIG. 1, according to the preferred embodiment of the present invention.
Figure 5:
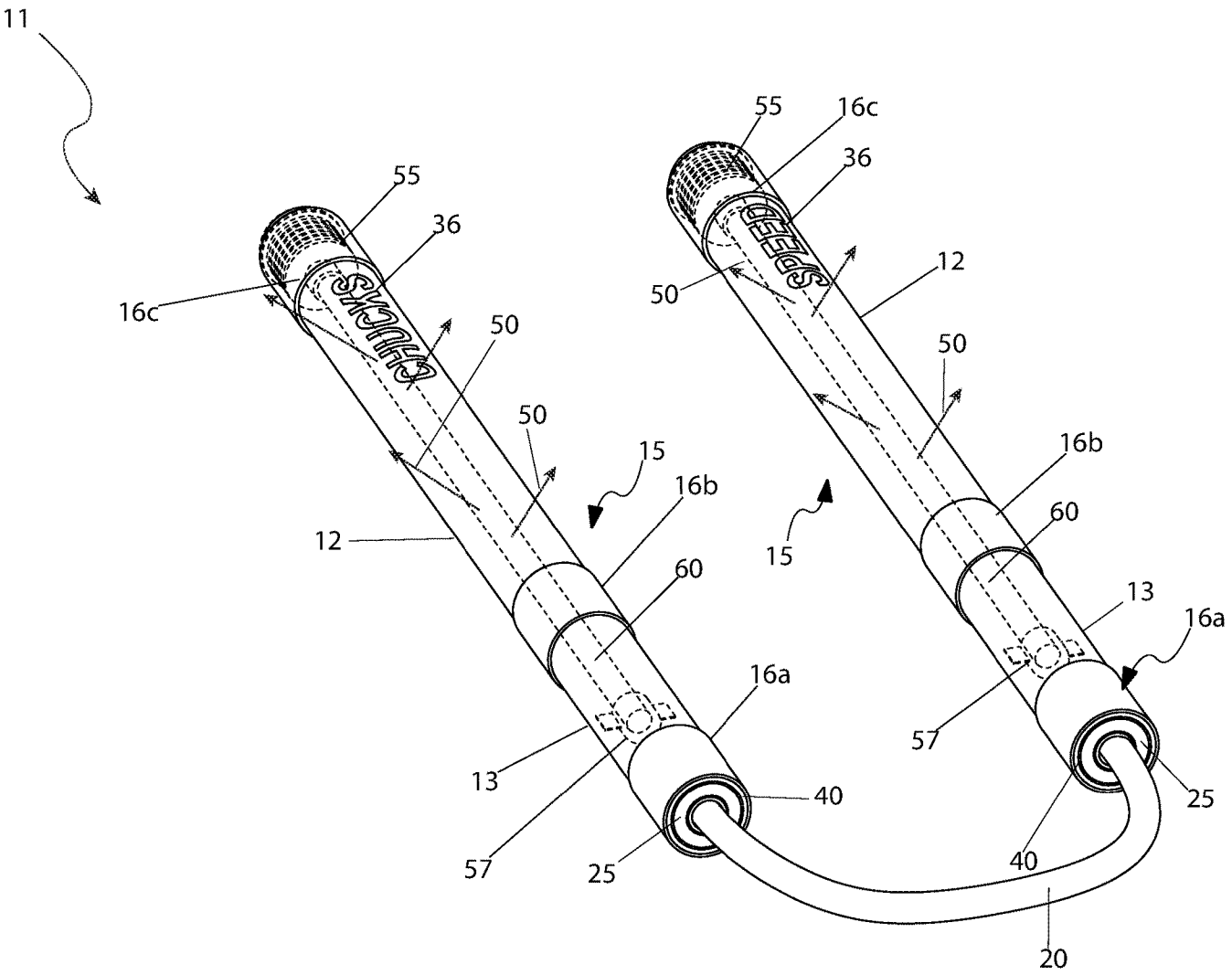
FIG. 5 is a perspective view of the nunchucks 11, according to an alternate embodiment of the present invention; and, FIG. 6 is a perspective view of the end plug 55 and chemical light stick 60, according to a preferred and alternate embodiment of the present invention.

The best mode for carrying out the invention is presented in terms of its preferred embodiment, herein depicted within FIGS. 1 through 4 and 6, and in an alternate embodiment depicted in FIG. 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the nunchucks 10 with visual and performance enhancements, according to the preferred embodiment of the present invention is disclosed. The nunchucks 10 (herein also described as the "device") 10, includes two (2) sticks 15 connected together via a tether 20. In a preferred embodiment, the sticks 15 are manufactured from metal tubing that is durable and possesses high strength properties. Aluminum or titanium are envisioned as possible materials of construction for the stick 15 although other metal and non-metal materials are also envisioned. As such, the materials of construction used in the stick 15 as well as the entire device 10 are not envisioned to be a limiting factor of the present invention. It is also noted that the overall dimension of the stick 15 as well as the length of the tether 20 are also widely variable depending on the specific needs of the user, and as such, are also not a limiting factor of the present invention.

Referring now more closely to FIG. 1, each stick 15 is defined as possessing a lower handle region 12 and an upper handle region 13. The distal end of the lower stick region 12 is open and capable of being plugged with an end cap 55. A lower band 16 circumscribes the outer perimeter of the stick 12 and overlaps the outer perimeter of the end plug 55. The lower band 16*c* is capable of attachment or removal and helps to keep the end plug 55 inserted into the open end of the lower handle region 12 of the stick 15. An intermediate band 16*b* is similarly constructed and removably placed on the stick 12. The location of the intermediate band 16*b* delineates the stick into the lower handle region 12 and upper handle region 13. The lower handle region 12 is envisioned to be seven to seven-and-a-half inches (7-7½ in.) in length and the upper handle region 12 is envisioned to be four to four-and-a-half inches (4-4½ in.) in length. The upper handle region 13 is sized to at least enable a final user to grip the stick 10.

Within the proximal end of the upper handle region 13 of each stick 15 as viewed in FIG. 1 has a sealed bearing assembly 25 which is the joining mechanism between the stick 15 and the tether 20. An upper band 16*a* is located at this section to aid in restricting detritus or foreign objects from entering the sealed bearing assembly 20 and hindering operation thereof. The sealed bearing assembly 25 allows for smooth quiet rotation of the tether 20 in a three-hundred-sixty-degree (360°) arc. Further description of the sealed bearing assemblies 25 will be provided here in below. The tether 20 is depicted as a heavy-duty nylon cable for purposes of illustration. Other types and styles of tether 20, including but not limited to: rope, wire, chain, and the like may be used with equal effectiveness. As such, the exact configuration of the tether 20 is not intended to be a limiting factor of the present invention.

In the preferred embodiment, a set of through-cut graphical elements 35 is provided along a length of the lower handle region 12, adjacent to the location of the lower band 16*c*. The through-cut graphical elements 35 is cut completely through the tubing wall 40, such that it exposes the interior cavity 45 (not shown due to illustrative limitations of the sticks 15. The through-cut graphical elements 35 preferably comprise text (as shown) in various fonts, numbers, and/or graphical designs such as logos, design elements, pictures, caricatures, or any indicia the like. The open nature of the through-cut graphical elements 35 allows for the emanation of illumination 50. Further description on the origination of the illumination 50 will be provided herein below.

Figure 2:
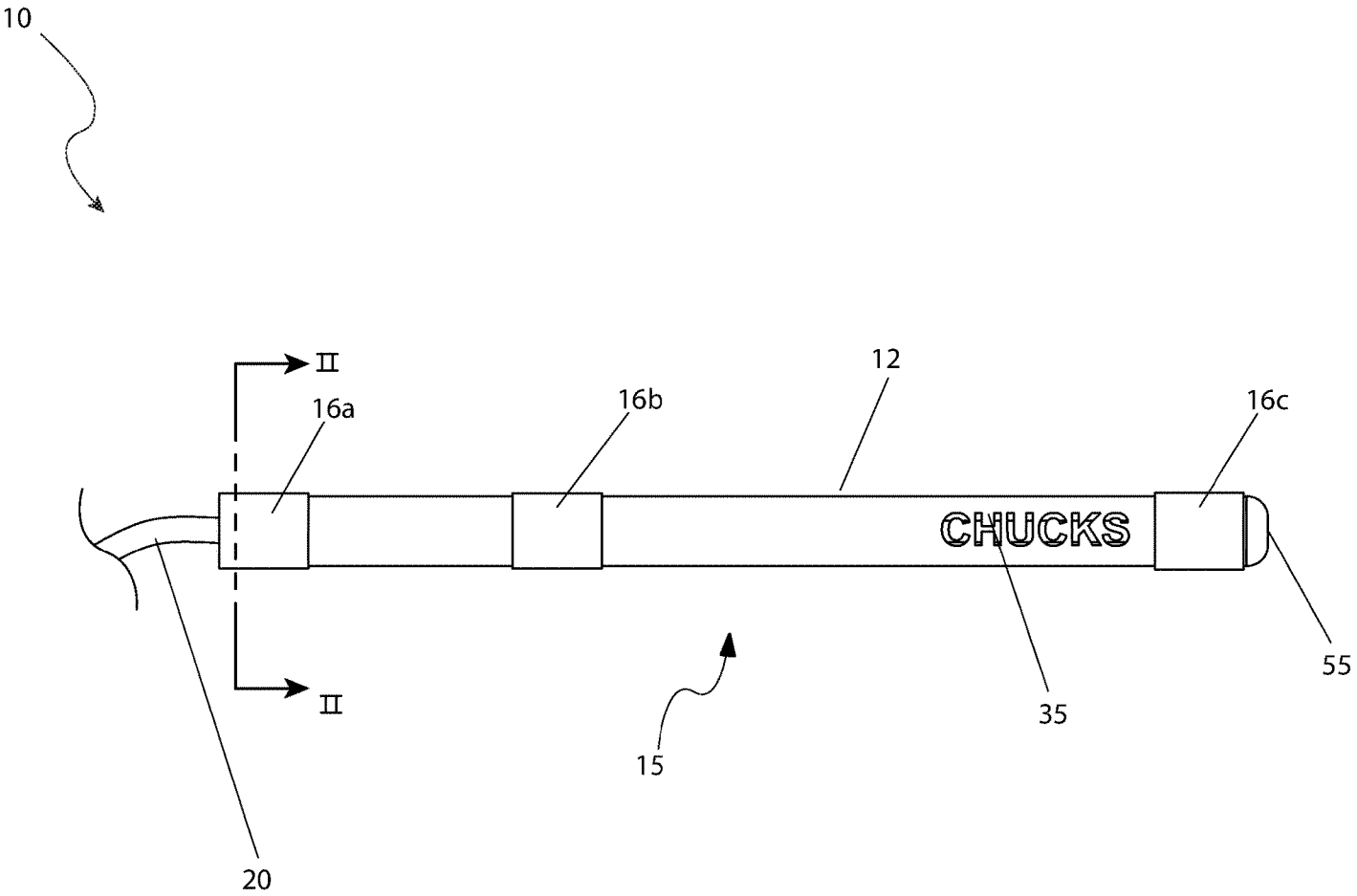
FIG. 2 is a side view of one (1) of the sticks 15, as used with the nunchucks 10, according to the preferred embodiment of the present invention.

Referring next to FIG. 2, a side view of one (1) of the sticks 15 as used with the preferred device 10 is depicted. It is noted that both sticks 15 are identical in construction. The stick 15, tether 20, and through-cut graphical elements 35 are identifiable as aforementioned described. The end plug 55 is removable in nature by the final user and is used to access the interior cavity 45 (not shown in this FIGURE) of the stick 15. The end plug 55 is manufactured from a pliable material, such as rubber. Further detail on the utilization of the end plug 55 will be provided herein below.

Referring now to FIG. 3, a sectional view of the device 10, as seen along a line I-I, as shown in FIG. 1, according to the preferred embodiment of the present invention is shown. This view discloses the interior cavity 45 of an individual stick 15 and additional details on interior mounted components of the stick 15. A chemical light stick 60 is disposed within the interior cavity 45 and is placed by the final user via removal of the end plug 55. The chemical light stick 60 is a self-contained, short-term light-source having a translucent plastic tube containing isolated substances that, when combined, produce light through chemiluminescence. The chemical light stick 60 is well known in the art and its individual components are not within the scope of the present invention. The chemical light stick 60 may be made in multiple colors, sizes and styles.

Figure 6:
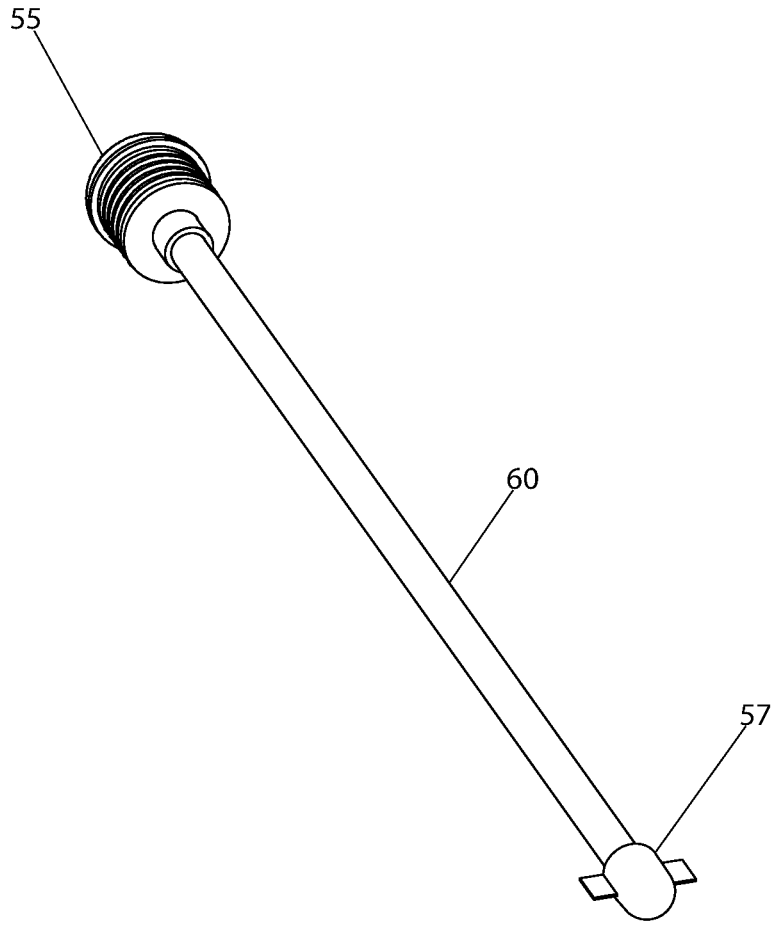

FIG. 6 illustrates the relationship between the end plug 55 and chemical light stick 60. A retaining strap 65, either an integral molded part of the chemical light stick 60, or a separate component that is physically attached to the end plug 55, is inserted through an aperture 70 provided in the center axial position of the end plug 55. The end plug 55 is held in place using a set of friction fit holding rings 75 which grip the interior cavity 45. A stopper 57 is placed over the opposing end of the chemical light stick 60 as a cap. The stopper 57 has a domed receiver and a pair of fins that are diametrically opposed and extend outward from the domed receiver. The end plug 55 along with the chemical light stick 60 is removed and inserted by applying physical force along a travel path "f" 80. The fins of the stopper 57 engage the interior of the stick 15 and prevent unintended removal of the chemical light stick 60 from the end plug 55 when the nunchucks 10 are used. Once activated, the chemical light stick 60 produces illumination 50 which emanate through the through-cut graphical elements 35 to produce a visual effect on the exterior of the stick 15.

The tether 20 is retained within a center bearing face 85 of the sealed bearing assembly 25 with the aid of a retention device 90 such as a crimp (as shown), a knot, heat fusion, a fastener, or the like. The sealed bearing assembly 25 is preferably an external seal face 95 (visible as seen in FIG. 1) along with an internal seal face 100. The external race 105 of the sealed bearing assembly 25 is secured within the interior cavity 45 of the stick 15 that is pressure-pressed in place using a well-known process. A set of ball bearings 110 provide minimal friction between the stick 15 and tether 20 to allow for easy movement along the rotational travel path 'a' 30 (as shown in FIG. 1).

Referring to FIG. 4, a sectional view of the device 10, as seen along a line II-II, as shown in FIG. 2, according to the preferred embodiment of the present invention is disclosed. The tether 20 is located at the center of the assembly with the internal seal face 100 immediately adjacent. The ball bearings 110 provide reduced friction and may or may not be lubricated. The internal seal face 100 contains the ball bearings 110 along their exterior. The tubing wall 40 is visible as the outermost layer.

Referring now to the alternate nunchuck embodiment 11, which is illustrated in FIG. 5. Each stick 15 is manufactured out of a transparent or translucent material, such as acrylic or a cross-linked polyethylene (PEX) material. The alternate nunchuck embodiment 11 has an overall size and shape similar to that of the preferred device 10, wherein the upper handle region 13, and lower handle region 12 are similarly configured. The alternate embodiment 11 also possesses the aforementioned description of the tether 20, sealed bearing assembly 25, end plug 55, and chemical light stick 60 providing the illumination 50.

Located in a similar location and configured in a similar manner as the through-cut graphical elements 35 of the preferred device 10 are decals 36 capable of adhering to the exterior surface of the stick 15. The illumination 50 produced by the chemical light stick 60 emanates through the transparent or translucent properties of the alternate nunchuck embodiment 11.

The upper band 16*a*, intermediate band 16*b*, and lower band 16*c* may be a resilient elastic material or a heat shrink wrap and is intended to aid in gripping the nunchucks 10, 11 but not interfering with the operation thereof. Such a thickness of the bands 16*a*, 16*b*, 16*c* is preferably seven-eighths to one inch (⅞-1 in.).

2. Operation of the Preferred Embodiment

The preferred embodiment of the present invention can be utilized by the common user in a simple and effortless manner with little or no training. It is envisioned that the device 10 would be constructed in general accordance with FIG. 1 through FIGS. 4 and 6, with the alternate nunchuck embodiment 11 depicted most clearly in FIG. 5. The user would procure either device 10, 11 via conventional procurement channels such as martial art studios, sporting good stores, mail order or internet supply houses and the like. Special attention would be paid to construction specifics such as overall length of the sticks 15 and the tether 20, diameter of the tether 20, color, style, specific through-cut graphical elements 35, bands 16*a*, 16*b*, 16*c*, illumination 50, and the like.

After procurement and prior to utilization, either device 10, 11 would be prepared in the following manner: the user would remove the end plug 55 from each stick 15 by applying opposing hand pressure along the travel path "f" 80; two (2) chemical light sticks 60 of the user's color choice would be activated using the activation process associated with the specific chemical light stick 60; an individual chemical light stick 60 would be secured within the aperture 70 of an individual end plug 55; said chemical light stick 60 and end plug 55 would be reinserted into each stick 15 by applying hand pressure along the travel path "f" 80. It is also noted that either device 10, 11 may be used without the insertion of the chemical light sticks 60 as aforementioned described. At this point in time either device 10, 11 would be ready for use.

During utilization of either device 10, 11 the following procedure would be initiated: as the internal seal face 100 are manipulated using practice and skill, the user is rewarded with fast and quiet motion due the reduced friction nature of the sealed bearing assemblies 25. Additionally, during nighttime or low light use, the user or any nearby viewers are rewarded with an eye-catching display of illumination 50 that move through arcs in a visually stunning effect. As the materials of construction used with either device 10, 11 are virtually indestructible under normal use, the user is free to hit or otherwise almost any surface without worry of damage the device 10 nor stoppage of the illumination 50 due to its chemical nature.

After use of either device 10, 11, the chemical light sticks 60 may be removed and discarded thus readying either device 10, 11 for future usage cycles as described above in a cyclical process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated

What is claimed is:

1. A pair of nunchucks, comprising:

a pair of sticks connected together by a tether, each of the pair of sticks includes a lower handle region and an upper handle region, a proximal end of the upper handle region of each of the pair of sticks having a sealed bearing assembly which is a joining mechanism between each of the sticks and the tether, each of the lower handle region includes a distal end that is open and plugged with an end cap;

a lower band circumscribing an outer perimeter of each of the sticks and overlaps each of the end plugs, the lower band is attached or removed to keep each of the end plugs inserted into each of the open ends of the lower handle region of the sticks;

an intermediate band removably placed on each of the sticks, the intermediate band delineates each of the sticks into the lower handle region and the upper handle region;

an upper band aiding in restricting detritus or foreign objects from entering the sealed bearing assembly and hindering operation thereof;

a set of through-cut graphical elements provided along a length of the lower handle region adjacent to the location of the lower band, the through-cut graphical elements are cut completely, such that it exposes an interior cavity;

a chemical light stick disposed within the interior cavity;

a retaining strap attached to the end plug is inserted through an aperture provided in a center axial position of the end plug; and a stopper placed over an opposing end of the chemical light stick as a cap, the stopper has a domed receiver and a pair of fins that are diametrically opposed and extend outward from the domed receiver, the fins of the stopper engage the interior of the stick and prevent unintended removal of the chemical light stick from the end plug when the nunchucks are used; and, wherein the tether is located at the center of the assembly with the internal seal face being immediately adjacent thereto, wherein the internal seal face contains a plurality of ball bearings along their exterior.

2. The pair of nunchucks according to claim 1, wherein each of the pair of sticks are identical.

3. The pair of nunchucks according to claim 1, wherein the end cap removably accesses an interior cavity.

4. The pair of nunchucks according to claim 1, wherein the end cap is made of pliable material.

5. The pair of nunchucks according to claim 4, wherein the end cap is made of rubber.

6. The pair of nunchucks according to claim 1, wherein each of the upper handle regions is sized to enable a final user to grip each of the sticks.

7. The pair of nunchucks according to claim 1, wherein each of the lower handle regions is in the range of seven to seven-and-a-half inches in length.

8. The pair of nunchucks according to claim 1, wherein each of the upper handle regions is in the range of four to four-and-a-half inches in length.

9. The pair of nunchucks according to claim 1, wherein the sticks are made from metal tubing.

10. The pair of nunchucks according to claim 9, wherein the metal tubing is durable and possess high strength properties.

11. The pair of nunchucks according to claim 10, wherein the metal tubing is aluminum.

12. The pair of nunchucks according to claim 10, wherein the metal tubing is titanium.

13. The pair of nunchucks according to claim 1, wherein the sealed bearing assembly allows for smooth quiet rotation of the tether in a three-hundred-sixty-degree arc.

14. The pair of nunchucks according to claim 1, wherein the tether is a heavy-duty nylon cable.

15. The pair of nunchucks according to claim 1, wherein each of the pair of sticks is made of a transparent material.

16. The pair of nunchucks according to claim 1, wherein each of the pair of sticks is made of a translucent material.

17. The pair of nunchucks according to claim 1, wherein each of the end plugs are held in place using a set of friction fit holding rings which grip the interior cavity.

18. The pair of nunchucks according to claim 1, wherein the through-cut graphical elements allows for emanation of illumination.

19. The pair of nunchucks according to claim 1, wherein the through-cut graphical elements are texts selected from the group consisting of fonts, numbers, graphical designs, logos, design elements, pictures, or caricatures.

20. The pair of nunchucks according to claim 1, wherein the chemical light stick is a self-contained, short-term light-source having a translucent plastic tube containing isolated substances that, when the isolating substances are combined, produce light through chemiluminescence.

* * * * *